United States Patent [19]

Goedicke

[11] 4,264,561

[45] Apr. 28, 1981

[54] CONVERTER FOR CATALYTIC CONVERSION OF EXHAUST GAS FROM AN INTERNAL COMBUSTION ENGINE

[75] Inventor: Eitel Goedicke, Bergheim, Fed. Rep. of Germany

[73] Assignee: Hoechst Aktiengesellschaft, Frankfurt am Main, Fed. Rep. of Germany

[21] Appl. No.: 45,073

[22] Filed: Jun. 4, 1979

[30] Foreign Application Priority Data

Jun. 5, 1978 [DE] Fed. Rep. of Germany ..... 2824567

[51] Int. Cl.[3] ..... B01J 8/04; F01N 3/28; F01N 7/14

[52] U.S. Cl. ..... 422/171; 60/299; 422/176; 422/179

[58] Field of Search ..... 422/171, 176, 177, 179; 60/299

[56] References Cited

U.S. PATENT DOCUMENTS

| | | | |
|---|---|---|---|
| 3,186,806 | 6/1965 | Stiles | 422/171 |
| 3,771,969 | 11/1973 | Scheitlin | 422/171 |
| 3,852,041 | 12/1974 | Moore et al. | 422/176 |
| 3,853,483 | 12/1974 | Cross | 422/179 |
| 3,947,252 | 3/1976 | Musall et al. | 422/179 |

*Primary Examiner*—Bradley R. Garris
*Attorney, Agent, or Firm*—Connolly and Hutz

[57] ABSTRACT

A converter for catalytic conversion of exhaust gas from an internal combustion engine comprising a double-shelled housing, of which the outer shell is spaced apart from the inner shell. The two shells are slidable with respect to one another and have a heat-retaining layer disposed there-between. The housing is provided with a gas inlet and gas outlet. Slidably mounted in the interior of the housing is at least one receptacle which has exhaust gas passage ways disposed in its upper and lower end portions. The receptacle(s) is (are) filled with granular catalyst forming a bed.

11 Claims, 3 Drawing Figures

Figure 1:
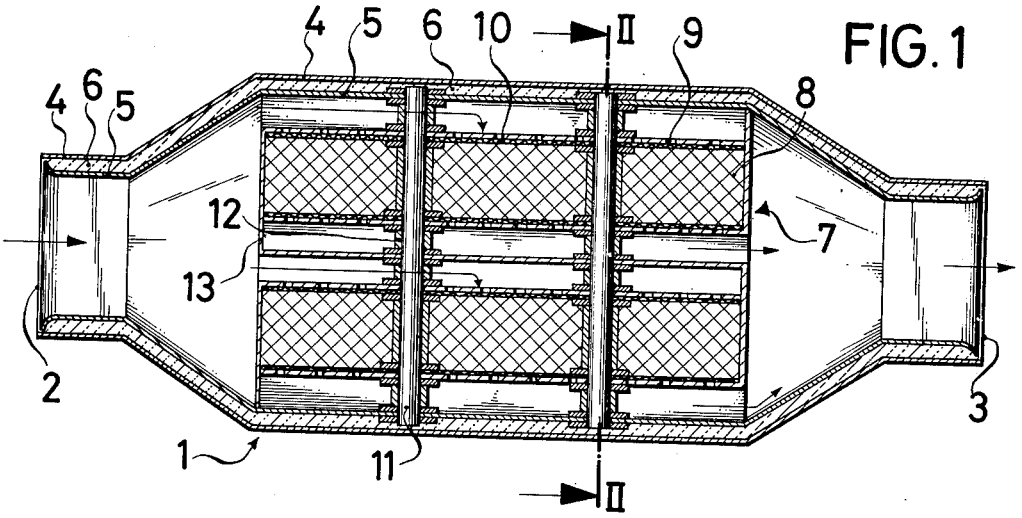

CONVERTER FOR CATALYTIC CONVERSION OF EXHAUST GAS FROM AN INTERNAL COMBUSTION ENGINE

The present invention relates to a converter for catalytic conversion of exhaust gas from an internal combustion engine, comprising a housing provided with a heat-retaining layer, a gas inlet and a gas outlet, a receptacle, which has exhaust gas passage ways disposed in its upper and lower sides, being slidably mounted in the interior of said housing, said receptacle being filled with granular catalyst forming a bed.

A converter for catalytic conversion of exhaust gas from an internal combustion engine has already been described in German Patent Specification "Auslegeschrift" No. 2 239 873, the converter comprising a housing which is heat-insulated with respect to the outside and subdivided into a lower and an upper half shell. Disposed in the interior of the space which is formed and bounded by the said two half shells forming the housing is an upper shell and a lower shell forming a receptacle of which each has an exhaust gas passage way passed through it. The two receptacle-forming shells are spaced apart by means of two vertically arranged supporting means of which the end portions are passed through the upper and lower shells forming the housing and rigidly connected thereto. The receptacle comprised of the said two shells is filled with particulate catalyst forming a bed. The housing is provided with a gas inlet and a gas outlet extending therethrough, the gas outlet being connected (in the direction of flow) to the receptacle and the gas outlet being connected (in the direction of flow) to the space formed between the receptacle and one of the half shells forming the housing.

The two half shells forming the housing are kept in position by the supporting means and tightly welded with respect to the outside and inside by means of a single peripheral through seam. The flat bed converter disclosed in German Patent Specification "Auslegeschrift" No. 2 239 873 is, however, not fully satisfactory inasmuch as it is necessary for it to be mounted remote from the engine (underframe mounting) because of the non-availability of free space in the room accommodating the engine. This means in other words that the catalyst bed comes into contact with exhaust gas of low or medium temperature only so that heating of the catalyst to starting temperature is unduly delayed.

In addition to this, the converter just described is serviceable at low or medium temperature only inasmuch as the thermally highly stressed catalyst-receiving receptacle and the lower and upper shells forming the housing, which is rigidly connected thereto, undergo thermal expansion which, however, remains unequalized. Needless to say, the converter is liable to break whenever the housing accommodating the resulting mechanical forces is subjected to thermal stress.

The deficiencies of the converter just described (use of flat large surfaced structural elements, non-equalization of thermal expansion, unfavorable contact of incoming gas with catalyst bed) result in unduly high catalyst abrasion.

It is therefore an object of the present invention to provide a converter for catalytic conversion of exhaust gas from an internal combustion engine, in which the bed of granular catalyst is maintained substantially under identical static and dynamic gas pressure so as to avoid relative movement of the catalyst granules with respect to each other. The compact construction selected for the present converter, which incidentally presents a reasonable catalyst volume and gas contact area, makes it possible for the converter to be mounted in narrow high or unsymmetrical places in the interior of the space accommodating the engine, and close thereto, which is highly desirable for various types of catalysts.

To this end, the invention provides more particularly a converter for catalytic conversion of exhaust gas from an internal combustion engine, which comprises: a double shelled housing provided with an exhaust gas inlet and exhaust gas outlet, the outer shell being spaced apart from the inner shell and the two shells being slidable with respect to one another; a heat-retaining layer being disposed between said inner shell and said outer shell; at least one receptacle having exhaust gas passageways disposed in its upper and lower sides being slidably mounted in the interior of the housing, the receptacle receiving granular catalyst forming a bed.

Preferred features of the present invention provide:

(a) for at least two receptacles which are spaced apart from one another and disposed one above the other, to be mounted in the interior of the housing;
(b) for at least three receptacles to be disposed in the interior of the housing;
(c) for a gas flow-defining cascade-plate to be mounted between two adjacent receptacles;
(d) for the housing to have extended through it, and through the receptacles and gas flow-defining plate therein, at least one vertically extending bolt, of which the upper and lower sides are passed through, and rigidly connected to, the inner shell so as to be slidable on the outer shell, a plurality of sleeves determining the spacing between the upper end and lower end of each receptacle between the individual receptacles and between the gas flow-defining plate and the receptacles, respectively, being slipped over the bolt;
(e) for the outer shell to be made up of ferritic steel or cast iron;
(f) for the inner shell to be made up of thin-walled high temperature steel or an alloy of low heat capacity;
(g) for the inner shell to have a wall thickness of 0.8 to 1.8 mm;
(h) for the receptacle to be provided with gas impermeable terminal surface areas and to have upper and lower sides of perforated sheet metal of which the side facing the catalyst has a fine-meshed wire gauze secured thereto;
(i) for the housing to have at least two bolts extended through it;
(j) for the housing to have at least three bolts extended through it;
(k) for the gas flow-defining plate to comprise a horizontal part and two vertical parts, the latter being in alignment with, and tightly connected to, the terminal surface area of the respective receptacle; and
(l) for the sleeves to have at least one collared end.

As a result of the compact construction selected for the present converter, which presents a small surfaced area and permits heat expansion phenomena to be equalized, it is not liable to undergo warping.

Exhaust gas is always introduced into the present converter through inlets opening laterally thereinto. Passageways formed between the inner shell and/or gas flow-defining plate and the upper side of the associated receptacle alter the direction of flow of the incoming gas and force it into contact with the catalyst bed, decontaminated gas issuing through similar lateral passage ways projecting outwardly from the converter. The enforced flow of gas through these passageways ensures uniform contact of the incoming exhaust gas with the catalyst bed, catalyst abrasion being substantially avoided. The gas-permeable structural components of the receptacle also contribute to avoiding catalyst abrasion. The catalyst is incidentally not liable to undergo abrasion in contact with sharp edges of the perforated sheet metal which is 0.7 to 2 mm thick, inasmuch as the invention provides for the fine-meshed wire gauze to be disposed between the perforated sheet metal and catalyst granules, the fine-meshed wire gauze having wires 0.5 to 1.5 mm thick, meshes 0.5 to 2 mm wide, and an opening width which is 10 to 90% the opening width of the perforated sheet metal.

In the converter of the present invention, use can be made of a plurality of, normally 2 to 4, catalyst beds through which parallel streams of gas can be passed from above to below and which provide large contact areas for the incoming gas so that the latter is substantially not liable to undergo any significant decrease in pressure.

The compact arrangement of the present converter enables an improved temperature level to be established inside the catalyst bed and to produce some limited heat abstraction effect in the space accommodating the engine.

Also, it is ensured by the present invention that thermal expansion phenomena become equalized relative to the thermally highly stressed structural components of the converter. In addition to this, the housing absorbing the resulting forces is substantially not liable to undergo significant thermal stress.

It is possible for the present converter to be mounted directly downstream of the exhaust gas collecting pipe of an internal combustion engine. It is even possible to omit the exhaust gas collecting pipe and, in this event, to connect the present converter directly to the engine.

In the converter of the present invention, the outer shell which is to accommodate the forces (e.g. tractional and bending stresses, pressure and oscillatory forces) can be made of commercially inexpensive steel or cast iron. This is rendered possible by the fact that the heat-retaining layer consisting of $Al_2O_3$ or $ZrO_2$ filamentory material, which is secured to the inside of the outer shell, enables this structural component to remain cold. The inner shell, receptacles and gas flow-defining plates in turn should preferably be made up of a high temperature steel or alloy, e.g. INCONEL, which can be kept thin-walled, the supporting function being assigned to the outer shell.

The converter of the present invention provides for thermal expansion phenomena, which the thermally highly stressed structural components are subjected to, to be equalized inasmuch as the slidable mounting of the inner shell makes it possible for it to be moved freely with respect to the cold outer shell, across the space which is formed between the two shells and occupied by the heat-retaining layer. The catalyst-filled receptacles in turn constitute a slidably supported unit which can freely move on the outer shell via at least one of the bolts, or undergo elongation and contration in the interior of the housing, below the limit of break.

Figure 2:
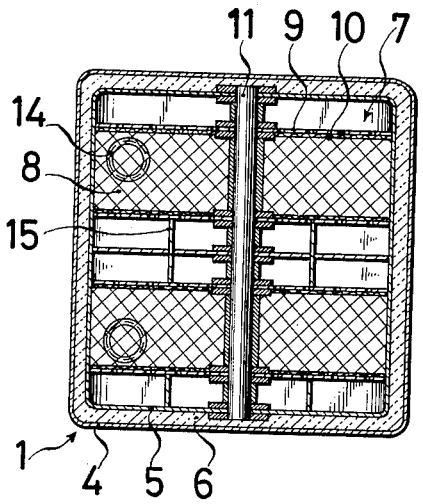

The converter of the present invention will now be described with reference to the accompanying drawings which are diagrammatic representations, partly in section, of exemplary embodiments, and of which FIG. 1 is a side elevational view of the converter showing details of a slidable mounting;

FIG. 2 is a cross-sectional view taken along lines II . . . II of FIG. 1; and

Figure 3:
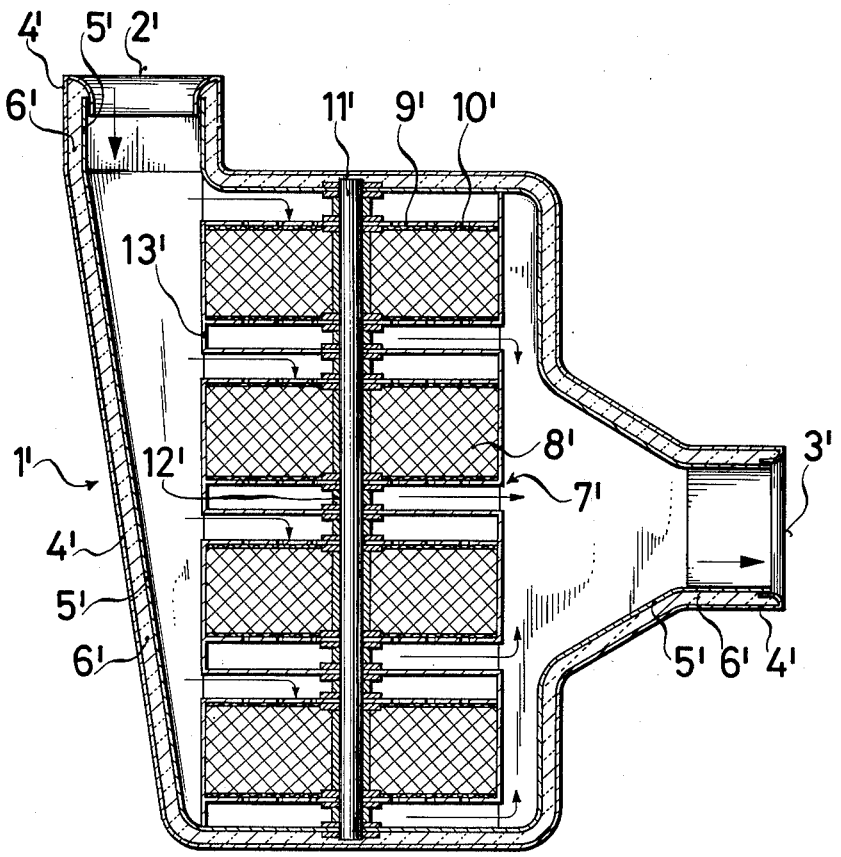

FIG. 3 (the reference numerals are here provided with a dash (') ) is a side elevational view of another exemplary form of the present converter showing details of two slidable mountings.

With reference to the drawing

The housing 1 of the converter, which is provided with a gas inlet 2 and a gas outlet 3, comprises an outer shell 4 and an inner shell 5. The shells 4 and 5 are arranged so as to be spaced apart substantially over their entire length and so as to slidably contact one another in the end region of gas inlet 2 and gas outlet 3, respectively. Placed between the outer shell 4 and inner shell 5 is a heat-retaining layer 6. Mounted one above the other inside the housing 1 are at least two receptacles 7, of which the upper and lower sides are permeable to gas. The receptacles 7 have a granular catalyst forming a bed 8 placed therein. The upper and lower walls of each container 7 are made up of high temperature resistant sheet metal (with openings or slots large in diameter) of which the side facing the catalyst granules has a fine-meshed wire gauze secured to it. The housing 1 has extended through it at least one vertically mounted bolt 11, of which the upper and lower ends open into, and are rigidly secured to, the inner shell 5. The bolt(s) has (have) a plurality of sleeves 12, of which the two ends are collared or provided with discs, slipped over it (them), the bolt(s) determining (a) the spacing between the upper side and lower side of each of the receptacles 7 and (b) the spacing between the individual receptacles 7, and between the receptacles 7 and the inner shell 5, respectively. Mounted between each two adjacent receptacles 7 is a gas flow-defining plate 13, which may take the form of a cascade. The horizontal portion of the plate 13 with one of the bolts 11 passed through it is mounted between, and held in position by, the collars of two of the respective sleeves. The vertical portions of the plate 13 are in alignment with the outside wall of the respective receptacle 7 and tightly linked thereto.

The receptacles 7 can be filled with granular catalyst from the outside by means of filling inlets 14.

The gas permeable surface areas of the various receptacles 7 find support by a plurality of spacers 15 (FIG. 2) which are disposed transversely with respect thereto.

I claim:

1. A converter for catalytic conversion of noxious pollutants of exhaust gas from an internal combustion engine, which comprises: a housing being provided with a gas inlet and a gas outlet comprised of an outer shell and an inner shell, said shells being disposed in spaced relationship with a layer of thermal insulation interposed therebetween and being slidable with respect to one another; at least two conversion chambers being slidably mounted in said housing and being spaced apart one above the other, each of said conversion chambers being adapted to hold granular catalyst forming a bed and having top and bottom perforate walls interconnected by imperforate side walls, said top and bottom perforate walls being comprised of perforated sheet metal, of which the side facing the granular catalyst has a fine-meshed wire gauze secured thereto; at least one step-like shaped gas flow-defining plate mounted between two adjacent conversion chambers; at least one bolt vertically extending through said housing, said bolt's upper and lower ends penetrating said inner shell, being rigidly connected therewith and being slidable on said outer shell; said conversion chamber and said gas flow-defining plate being perpendicularly penetrated by said bolt; and a plurality of sleeves being slipped over the bolt so as to fix the distances between said top and bottom perforated walls of each conversion chamber, between said gas flow-defining plate and said conversion chambers and between said inner shell and said conversion chambers, respectively.

2. The converter as claimed in claim 1, wherein at least three conversion chambers are mounted in the interior of the housing.

3. The converter as claimed in claim 1, wherein the outer shell is made up of ferritic steel.

4. The converter as claimed in claim 1, wherein the outer shell is made up of cast iron.

5. The converter as claimed in claim 1, wherein the inner shell is made up of thin-walled high temperature steel.

6. The converter as claimed in claim 1, wherein the inner shell is made up of an alloy of low heat capacity.

7. The converter as claimed in claim 5 or 6, wherein the inner shell has a wall thickness of 0.8 to 1.8 mm.

8. The converter as claimed in claim 1, wherein at least two bolts are extended through the housing.

9. The converter as claimed in claim 8, wherein at least three bolts are extended through the housing.

10. The converter as claimed in claim 1, wherein each sleeve has at least one collared end.

11. The converter as claimed in claim 1, wherein the gas flow-defining plate comprises a horizontal structural component and two vertical structural components, the latter being in alignment with, and tightly connected to, the imperforate side walls of the respective conversion chambers.

* * * * *